US006832453B2

(12) United States Patent
Petroski et al.

(10) Patent No.: US 6,832,453 B2
(45) Date of Patent: Dec. 21, 2004

(54) RADIAL STORE SYSTEM

(76) Inventors: Henry Petroski, 3910 Plymouth Rd., Durham, NC (US) 27707; Stephen J. Petroski, 18705 Ronceverte Dr., Cornelius, NC (US) 28031

( * ) Notice: Subject to any disclaimer, the term of this patent is extended or adjusted under 35 U.S.C. 154(b) by 0 days.

(21) Appl. No.: 10/331,030

(22) Filed: Dec. 26, 2002

(65) Prior Publication Data

US 2004/0123533 A1 Jul. 1, 2004

(51) Int. Cl.[7] ..... E04H 3/02

(52) U.S. Cl. ..... 52/174; 52/169.2

(58) Field of Search ..... 52/174, 169.2; 108/118, 134

(56) References Cited

U.S. PATENT DOCUMENTS 5,605,237 A * 2/1997 Richardson et al. ..... 211/59.3

* cited by examiner

*Primary Examiner*—Ramon O. Ramirez
*Assistant Examiner*—Ingrid Weinhold

(57) ABSTRACT

This invention relates to store systems laid out with shelves and aisles radiating, out from a central hub area. The arrangement of the shelves and aisles allows a customer to enter and begin shopping at any one of a plurality of places around the periphery of the store and to move easily and directly from any aisle to any other aisle through the central hub area. The arrangement lends itself to having unobstructive checkout lines located at a variety of locations around the periphery of the store. The layout extends to the parking lot, whose lanes are also laid out in a radial fashion. The store layout lends itself to being mounted on a revolving structure, which serves to showcase all sections of the store, attract customers to the store, make every parking space equally convenient and appealing to shoppers, and reduce congestion and danger in the parking lot.

4 Claims, 3 Drawing Sheets

RADIAL STORE SYSTEM

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, ETC.

Not Applicable

BACKGROUND OF THE INVENTION

Large store systems typically are laid out in an enclosed rectangular space, with shelving for merchandise and aisles for shoppers arranged along lines parallel to the exterior walls of the store building. The shopper typically progresses through the store by going down one aisle and up the next. To go directly from the first aisle to the last requires that customer travel the length of the store.

After selecting all the items desired, the shopper must proceed to a checkout area, where all the parallel checkout lanes are located in a confined space. This area is often crowded with lines of other shoppers, not only making it difficult to proceed directly to a given checkout counter but also making it difficult for shoppers who are still shopping to get from one aisle to another. Both shoppers waiting in line to check out and those trying to get from one aisle to another can become frustrated with the congestion and develop a negative impression of their shopping experience.

The entrance and exit of such stores are typically singular in number and may or may not be near each other, but either arrangement can make parking a motor vehicle in the establishment's parking lot a frustrating experience for a shopper, who usually prefers to park as close to both as possible, especially in inclement weather. When the store entrance and exit are located next to each other, the parking spaces in their vicinity quickly get taken up, thus concentrating traffic in the precise area where shoppers are walking to and from their cars. Those shoppers who cannot find a parking space close to the entrance and exit do not enter or leave with a favorable impression of the store.

In some stores, the entrance and exit are separated by a good distance. In such an arrangement, there are no parking spaces that are convenient to both store entrance and store exit. Such an arrangement also can frustrate shoppers, who must walk some distance either just before or just after the shopping experience in the store. In such situations, the preferred parking spaces are midway between entrance and exit, which causes those areas in the parking lot to become most congested and dangerous for drivers and pedestrians alike.

A new arrangement for a store system not only would improve movement within the store and alleviate congestion at checkout areas but also would lessen parking congestion and reduce dangerous traffic patterns in the parking lot surrounding the store building.

SUMMARY OF THE INVENTION

In accordance with one embodiment of the present invention, a revolutionary store system is provided, whose floor plan is essentially circumscribed by a circle or a polygon of many sides. This system involves arranging the shelving units and aisles between them in a radial fashion on a floor structure, with a hub area at the center of the store facilitating movement among the various aisles. The checkout counters are spaced at regular intervals all around the outer edge of the store and are located just inside the outside wall of the store and oriented more or less at right angles to the aisles in the vicinity. With this configuration, lines of shoppers waiting to check out align themselves more or less around the periphery of the store, and in this way do not interfere with customers still shopping and moving around the end of one aisle to reach another. Entrances and exits to the store are arranged near all checkout stations, which are spaced at regular enough intervals to be convenient to every aisle but sufficiently far apart so that entrances are not blocked by lines of shoppers waiting to check out. The parking lot of the circular store is more or less annular in configuration, thus distributing parking spaces all around the structure. All parking space locations are equally convenient, since an entrance and exit will always be located nearby, a very desirable feature in inclement weather. In one embodiment, the entire store is mounted on a slowly revolving floor structure, much as is done with a revolving restaurant, thus providing a distinctive identifying feature to attract customers and also bringing every entrance to and exit from the store in even closer proximity to every parking space in the surrounding parking lot.

DETAILED DESCRIPTION OF THE INVENTION

Figure 1:
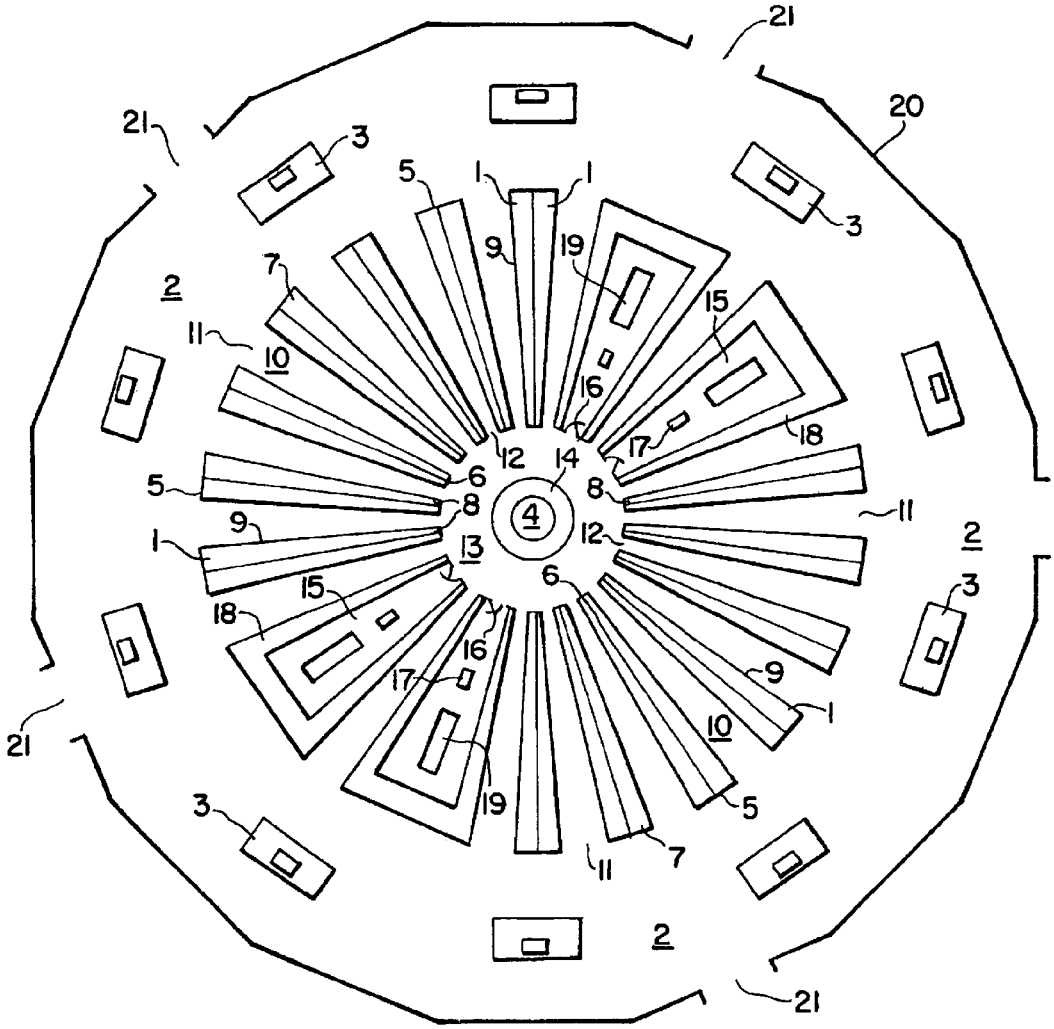
FIG. 1 is a schematic top view of one embodiment of a radial store system.

One embodiment of the present invention is represented in FIG. 1, which shows the schematic the floor plan of a store contained within a structure of more or less circular geometry. This arrangement can support the usual components of a typical supermarket, which will be used as an illustrative system. In order to contain 50,000 gross square feet of floor space, which is taken here as the size of a representative store, the diameter of the circular store would have to be about 250 feet, which is not an unreasonable size.

The shelving 1 on which the merchandise is displayed is arranged substantially radially on the substantially circular floor 2, but it does not extend fully to the center or to the outer edge of the store, to allow room around the periphery for checkout lines and counters 3 and to allow room in the center hub area 4 of the store for movement between aisles and other uses, as will be described below. Because of the nature of the geometry of a circle, the radially aligned shelving will be wider at the outer end 5 than at the inner end 6. This variation in shelving depth can be turned to advantage by shelving large, heavy, and bulky items like packages of disposable diapers, bags of dog food, and bottled drinks on or near the deeper portion 7 of a shelf and small, light, and compact items like spices, teas, and cans of tuna fish on or near the shallower portion 8 of a shelf. If the edges of the shelves 9 are strictly radial, then also the aisles 10 would necessarily be wider at the outer end 11 and narrower at the inner end 12. The minimum practical aisle width desired by the store would fix the distance between the shelving on either side of an aisle, or the shelving layout could deviate from the true radial to allow more flexibility in shelf and aisle width.

The width of the aisles will also depend upon how far from the center of the store the shelving terminates. This in turn will depend on the store's desired use of the hub area 4 and the surrounding annular area 13. One possible option is to leave the center hub completely open, so that shoppers can move virtually unimpeded from the inner end of any aisle to the inner end of any to any other aisle in the store. Another possible use of the hub area is as a kind of "public square," where shoppers can stop to talk with friends and acquaintances that they encounter as they move from one aisle to another across the "square." Alternately, a coffee shop with tables and chairs can be located at the center of the "square" to promote and encourage such encounters and thus enhance the shopping experience. Still another option is for the store to locate its service and information desk 14 at the center of the store, making it equally convenient to shoppers approaching from any aisle. The store could also locate the manager's office or a security office in an elevated space atop the hub. From such a vantage point, every aisle would be in clear view, and the entire store could be watched with ease, allowing quick detection of wet or dirty floors, fallen merchandise, or shoplifting activity. Other uses of the hub area are also possible.

Figure 2:
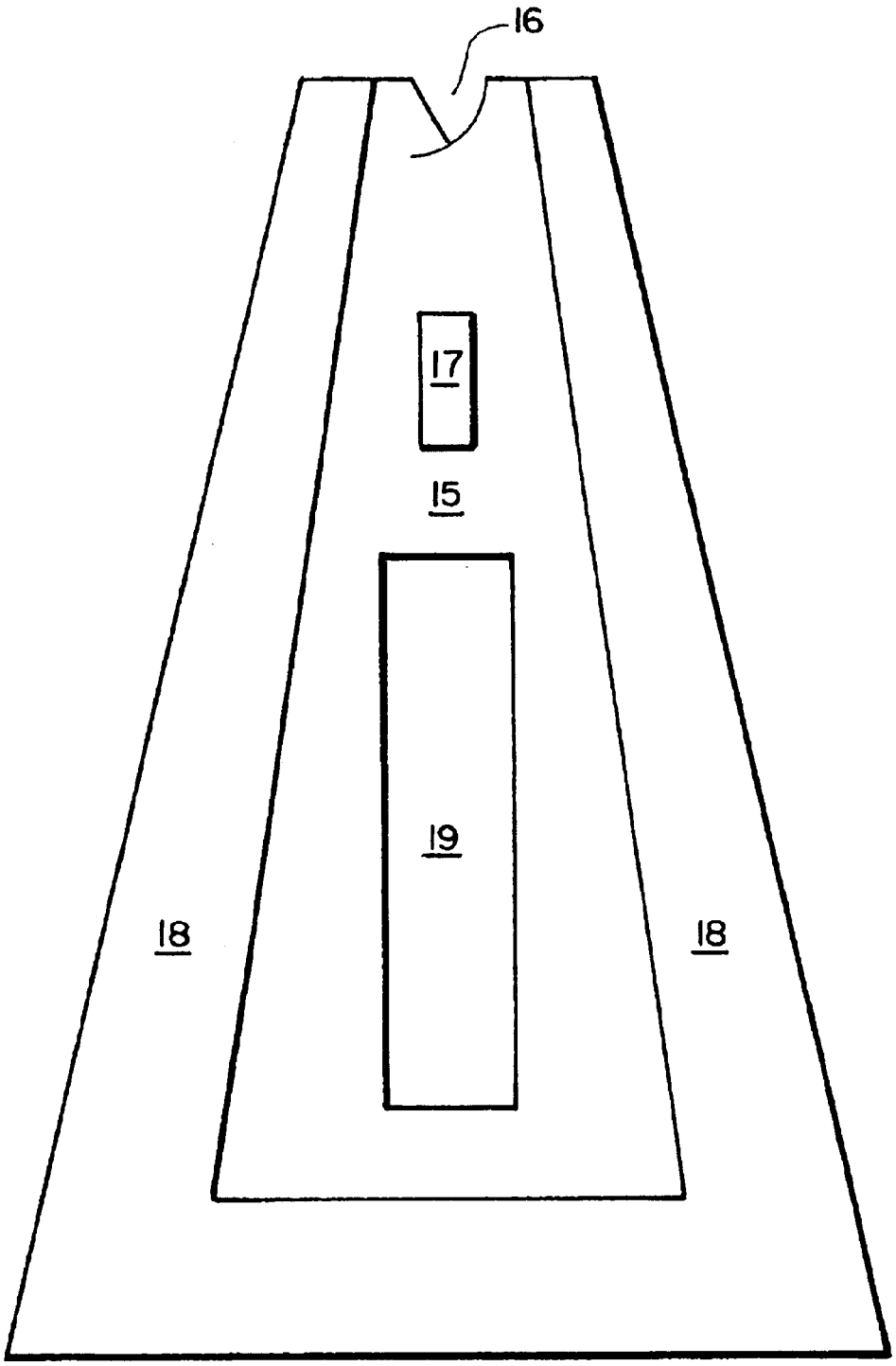
FIG. 2 is a schematic top view of a staging area between shelving or display units, making them accessible for restocking from the side away from the customer aisles.

Not all aisles in a typical supermarket are flanked by plain shelving, of course. Produce, dairy, frozen food, and other special climate sections must necessarily be accommodated. As suggested in FIG. 2, this can be done within a radial arrangement of shelves as easily as it is done in a conventional rectilinear store layout. Where the presence of attendants or clerks is required, as it is in meat, fish, delicatessen, and like sections, the aisle 15 between two shelving units can be closed off at its ends (except for an access door 16 to the interior space) and fitted with tables 17 and other elevated surfaces used for the preparation and packaging of the items sold in that section. Instead of shelving units enclosing the work area, it is surrounded with display cases 18, which are specialized for meats, cheeses, vegetables, prepared foods, and the like and can be accessed by clerks or restocked from within the work area. A floor opening within the work area 15 provides access 19 to the stockroom located in the lower level.

As shown in FIG. 1, checkout counters 3 in the circular store are located at regular intervals all around the outer edge 20 of the substantially circular store (practical construction considerations would likely dictate a polygonal periphery), so that wherever a shopper finished up selecting items there would be a checkout counter nearby. The checkout counters would be aligned more or less at right angles to the shelving 1 in the area and more or less parallel to the tangent to the nearby outer edge of the store 20, and spaced sufficiently far apart so that lines of customers waiting at the checkout counters would form more or less parallel to the outer edge 20 of the store. In this way, shoppers waiting in a line to check out would not block the passage of other shoppers moving from aisle to aisle around the outer end 5 of a shelving unit. Extensive use of automated self-service checkout stations and anti-theft systems would allow for the plurality of peripheral checkout stations to remain open even during periods of slow business.

Figure 3:
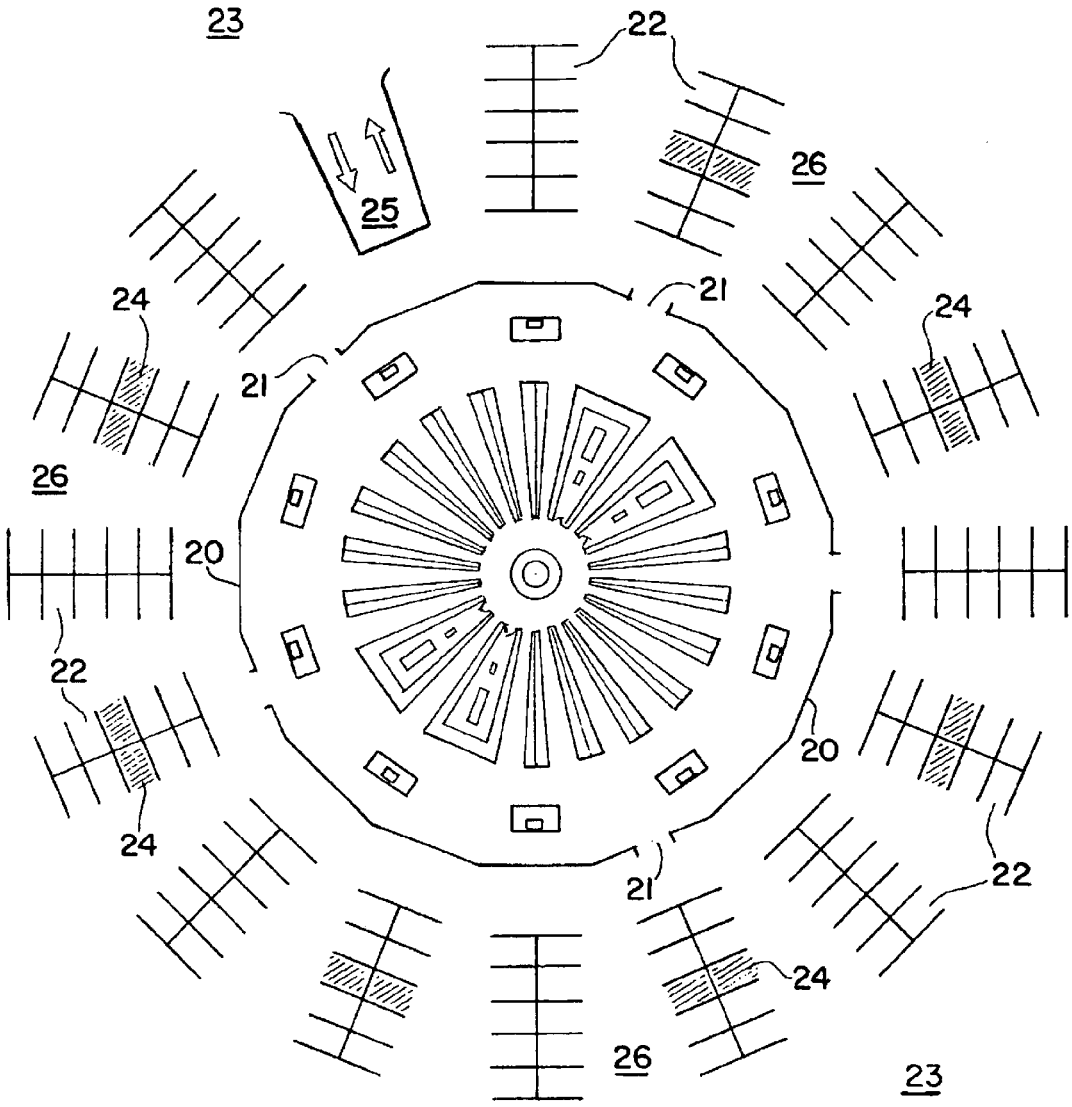
FIG. 3 is a schematic top view of a radial store system and its surrounding parking lot.

Between each pair of checkout counters is a set of entrance and exit doors 21. As indicated in FIG. 3, with this arrangement no shopper would ever have to walk very far from a parking space 22 in the annular parking lot 23 surrounding a circular store. Indeed, a shopper driving up to the store could see through its encircling plate glass windows and doors where the various sections of the store were located and could park accordingly. After shopping, customers can walk around the store's periphery until reaching an exit that is near their car in the parking lot. This will be especially convenient when it is raining or the weather is otherwise inclement.

The only parts of the all-surrounding parking lot that are not available for parking are the shopping basket return areas 24 and the entrance 25 to a ramp driveway leading down into a tunnel through which vehicles gain access to the basement space beneath the store. This access serves delivery, maintenance, and other vehicles needing to gain access to the area housing heating, air conditioning, refrigerating, and other mechanical equipment, as well as a loading dock serving the stockroom for the store.

The stockroom would typically be more or less congruent with the store level, and the stock could be arranged more or less in the same relative positions as the items are on the shelves in the store above. With the stock so logically arranged, it could be readily located even by inexperienced stockroom clerks, and it could be delivered as needed to the store level for replenishing items taken off the shelves by shoppers. The method of delivery of stock from the basement stockroom to the store level could take many forms, including one akin to baggage handling at major airports. Boxes of goods in the basement storage area could be loaded onto conveyor belts that would carry them up to a carrousel rotating around the hub 4 of the store. Such an embodiment would necessarily occupy space in the hub area not then available for other uses, but this carrousel space could also be enclosed within a circular wall, leaving the annular space 13 between it and the inner ends 6 of the shelves available for the variety of uses described above.

Other means of transporting fresh stock from the stockroom to the store level are also possible. Among these can be the use of conveyor belts within the openings 19 to carry stock from the lower level stockroom up into staging areas concealed behind back-to-back shelving segments, as in FIG. 2, thus allowing shelves or display cases to be restocked from behind. This has the advantage of not obstructing aisles with boxes, stock carts, and stock persons. The geometry of such stock staging areas could be adjusted by having the shelf line deviate slightly from the true radial, which could also have the added advantage of making aisles of constant width from inner to outer ends.

As an additional means of distinguishing such a radially arranged store from establishments laid out according to the prior art, and also as a means of providing further conveniences of use for customers, the radial store system can be mounted on a revolving platform, much like a revolving restaurant. The state of the art of revolving restaurants located atop tall buildings is such that the mechanical equipment needed to support and rotate such a structure are well within existing capabilities. If the store makes as much as one complete revolution every fifteen minutes, then the periphery of the floor structure will be moving relative to the ground at approximately one-half mile per hour, which is well within the experience of ordinary people in mounting such devices as chair lifts, amusement park rides, escalators, and moving sidewalks.

With a revolving store, every entrance and exit would at some time in the cycle be conveniently located for every lane 26 in the parking lot. This would tend to distribute parked cars uniformly around the parking lot, thus reducing frustration among drivers looking for a good parking space and minimizing traffic congestion at any single location.

The mechanical- and stockroom need not revolve with the shopping level of a revolving store. Stock transferred from a stationary lower level to a rotating upper one would not present insurmountable technical obstacles, given the state of the art of baggage handling in airports.

In an alternate embodiment, only a portion of the entire floor of the store revolves. The hub area, for example, could remain stationary, for the purposes of the café, service, office, surveillance, or other use to which it was put. Alternately or also, an outer ring area of the store, on which the checkout counters are located, could be stationary, allowing for a conventional ground mounted structural framing system capable of supporting a long-span roof and a curtain wall encircling the building. In this way the revolving floor system would not bear any of the dead load of the enclosing structure. Whether enclosed in such a ground-based structure or carrying the structure on the revolving platform, any transitions between stationary and revolving portions of the floor of the store can be based on the technology used in revolving restaurants.

We claim:

1. A store of substantially circular geometry including:

(a) a plurality of shelving units separated pairwise by aisles arranged substantially radially around a central hub area, thus providing substantially clear lines of sight from said central hub area down all said aisles and providing convenient access between any two said aisles of said store;

(b) a plurality of entrances and exits to said store angularly displaced at substantially equal intervals around a perimeter of said store, thus providing convenient access to and egress from any location around or within said store;

(c) a plurality of checkout counters within the perimeter of said store arranged substantially at right angles to nearby said shelving units and said aisles and substantially proximate to said entrances and exits, thus enabling customers checking out to form lines concentric to and within said perimeter that do not block customers still shopping;

(d) an annular parking lot concentrically surrounding said store with rows of parking spaces arranged radially around said store and located away from said perimeter with an open lane encircling the immediate vicinity of said store, thus providing a plurality of parking spaces around said store and leaving clear said entrances and exits of said store.

2. The store of claim 1, in which said central hub area is left substantially unobstructed, thus allowing substantially unimpeded movement across said central hub area between any two said aisles of said store.

3. The store of claim 1, in which a plurality of said shelving units and said aisles are display cases delineating a truncated-wedge shaped area and enclosing a restricted work space, thus allowing shoppers to custom order delicatessen items, cuts of meat, and the like from store employees working within said restricted space.

4. The store of claim 1 adapted to be rotatable, thus providing not only a distinguishing characteristic of said store but also enabling customers to enter the store from a plurality of directions from the parking lot and to ride the store structure to within close proximity of their parked car.

* * * * *